United States Patent [19]

Oaku et al.

[11] Patent Number: 4,504,312

[45] Date of Patent: Mar. 12, 1985

[54] WEAR-RESISTANT SINTERED FERROUS ALLOY AND METHOD OF PRODUCING SAME

[75] Inventors: Takaaki Oaku, Yokosuka; Yoshihiro Maki, Miura; Yasuzi Hokazono, Yokohama, all of Japan

[73] Assignee: Nissan Motor Company, Limited, Yokohama, Japan

[21] Appl. No.: 506,767

[22] Filed: Jun. 22, 1983

[30] Foreign Application Priority Data

Jul. 6, 1982 [JP] Japan ..... 57-116275

[51] Int. Cl.[3] ..... B22F 3/00

[52] U.S. Cl. ..... 75/244; 75/242; 75/246; 419/10; 419/11; 419/12

[58] Field of Search ..... 75/242, 244, 246; 419/10, 11, 12

[56] References Cited

U.S. PATENT DOCUMENTS

| | | | |
|---|---|---|---|
| Re. 28,552 | 9/1975 | Smith | 75/246 X |
| 3,945,863 | 3/1976 | Precht | 419/23 |
| 4,123,266 | 10/1978 | Foley et al. | 75/244 |

*Primary Examiner*—Leland A. Sebastian

*Attorney, Agent, or Firm*—Schwartz, Jeffery, Schwaab, Mack, Blumenthal & Koch

[57] ABSTRACT

A highly wear-resistant sintered ferrous alloy which consists essentially of 2.0–8.0% of Cr, 0.1–1.0% of B, 1.0–2.5% of Si, 0.3–1.2% of Mn, 1.2–3.8% of C, by weight, and the balance of Fe. The alloy is produced by compacting and sintering a powder mixture, which is preferably prepared by mixing 75–90 parts by weight of a cast iron powder with 25–10 parts by weight of a Fe—Cr—B—Si alloy powder.

5 Claims, No Drawings

WEAR-RESISTANT SINTERED FERROUS ALLOY AND METHOD OF PRODUCING SAME

BACKGROUND OF THE INVENTION

This invention relates to a wear-resistant sintered ferrous alloy for parts subjected to friction and a method of producing the same.

A typical example of metal parts that make continuous rubbing contact with another metal part is the rocker arm of an internal combustion engine. It is usual to form the tip part of the rocker arm by chilled casting separately from the main part of the rocker arm or alternatively to harden the tip portion of the rocker arm made of steel by either a suitable heat treatment such as carbrizing or nitriding or a surface treatment such as chormium plating.

As the performance requirements to the recent internal combustion engines for automotive uses have become more and more severer, there is the tendency to press the rocker arms against the cams under increased pressures. Then there arises a problem that the supply of lubricating oil into the interface between the cam surface and the rocker arm tips becomes insufficient while the cam rotation rate is low and hence the sliding speed of the rocker arm tip relative to the cam surface is low as occurs during idling or very low speed operation of the engine. The insufficiency in lubrication often results in serious wear or scuffing of the rocker arm tip made of a usual material or peeling of the plated hard film from the rocker arm body.

It is possible to use a sintered porous alloy that is impregnated with oil to become self-lubricating and resistant to wear. In that case, however, the sintered alloy needs to contain relatively large amounts of special and costly metals such as W and/or Mo in order to acquire hardness sufficient for use in parts subjected to severe rubbing or friction. If the contents of such costly metals are decreased to reduce the cost of the alloy, then it becomes necessary to subject the sintered alloy parts to a hardening treatment such as heat treatment or surface treatment so that the production of the alloy parts becomes complicate with inevitable rise in the production cost.

SUMMARY OF THE INVENTION

It is an object of the present invention to provide a sintered alloy which has such high wear resistance as is sufficient for parts subjected to severe rubbing such as the rocker arm tips in recent automotive internal combustion engines but is relatively weak in the tendency of attacking another metal material with which the sintered alloy parts make rubbing contact and can be produced at relatively low costs.

It is another object of the invention to provide a method of producing a wear-resistant sintered alloy according to the invention.

The present invention provides a wear-resistant sintered ferrous alloy which consists essentially of 2.0 to 8.0% of Cr, 0.1 to 1.0% of B, 1.0 to 2.5% of Si, 0.3 to 1.2% of Mn, 1.2 to 3.8% of C, by weight, and the balance of Fe.

A sintered alloy according to the invention is produced by the steps of preparing a powder mixture which is composed essentially of the above named metals and carbon in the proportions corresponding to the composition of the sintered alloy, compacting the powder mixture into a body of desired shape, and sintering the compacted body in a nonoxidizing atmosphere.

Preferably the powder mixture is prepared by mixing a powder of a cast iron with a powder of a quaternary alloy which consists essentially of 10.0 to 35.0% of Cr, 1.0 to 2.5% of B, 0.5 to 3.0% of Si, by weight, and the balance of Fe in the proportion of the cast iron powder to the quaternary alloy powder of 75:25 to 90:10 by weight.

A wear-resistant sintered alloy of the invention has a Fe-C base matrix which is principally sorbite or bainite and may partly be pearlite, and hard carbides and borides in particulate form are uniformly dispersed in the matrix. Preferably the matrix exhibits a hardness number of about 300–500 mHv (measured by Vickers microhardness method), and the particulate carbides and borides are about 50–150 $\mu$m in mean particle size, about 900–1300 mHv in hardness and amount to about 10–40% by surface area in any section of the sintered alloy.

A sintered alloy of the invention is very high in wear resistance but very weak in the degree of attack against an opposite metal material with which the sintered alloy makes rubbing contact. In most cases parts formed of this sintered alloy and to be subjected to rubbing or friction need no post-sintering hardening treatment such as heat treatment. This alloy does not use very costly metals such as Mo and W, and can easily be produced by using conventional powder metallurgy techniques. Besides, an ordinary cast iron powder obtained as chips in machining operations can be used as a basic and major material for this sintered alloy. Accordingly this excellent sintered alloy can be produced at very low costs. This sintered alloy is quite suitable for the rocker arm tips in the recent automotive internal combustion engines.

DESCRIPTION OF THE PREFERRED EMBODIMENTS

A wear-resistant sintered ferrous alloy according to the invention has the composition specified above. The effects of the respective alloying elements and the reasons for the limitations of the amounts of the respective elements are as follows. Throughout the following description, the amounts of the elements in the alloy are given in percentages by weight.

(1) Chromium: 2.0–8.0%

Cr combines with B and Fe and also with C and Fe to form borides and carbides in particulate form and, therefore, contributes mainly to enhancement of the wear resistance of the sintered alloy. To fully obtain the effects of Cr, it is important that the content of Cr in the alloy be balanced with the contents of B and C. When the content of Cr is less than 2% it is impossible to form sufficient amounts of borides and carbides that serve as hardening components, so that the wear resistance of the alloy will remain insufficient. When the content of Cr is more than 8% it is difficult to produce a sintered alloy body having sufficiently high mechanical strength because the powder composition to be compacted and sintered becomes too high in its hardness and inferior in formability and also because the amount of liquid phase produced at the stage of sintering becomes insufficient.

(2) Boron: 0.1–1.0%

As mentioned above, B combines with Cr and Fe to form hard borides. When the content of B in the alloy is less than 0.1% the precipitation of such borides remains insufficient. When the content of B exceeds 1% the particles of the borides become so coarse that during rubbing contact of the sintered alloy with another material the borides particles will seriously attack that material. Besides, the powder composition before sintering becomes inferior in formability.

(3) Manganese: 0.3–1.2%

Mn enters the matrix of the sintered alloy as a constituent of solid solution and contributes to improvement in the hardenability of the sintered alloy. When the content of Mn in the alloy is less than 0.3% the matrix of the alloy becomes mostly pearlite, but when the content of Mn exceeds 1.2% a certain amount of austenite remains in the matrix. To realize a desired matrix structure that is sorbite or bainite (possibly with coexistence of some pearlite) and to enhance the wear resistance of the alloy, the content of Mn must be within the range from 0.3 to 1.2%.

(4) Silicon: 1.0–2.5%

In preparing the powder composition to be sintered by an atomizing method for example, Si in the composition has the effect of improving the fluidity of the molten metal. Besides, Si serves as a deoxidizer. These effects remain insufficient when the content of Si is less than 1%, but an increase in the Si content beyond 2.5% will result in lowering of the wear resistance of the sintered alloy by reason of lowering of the hardenability of the alloy matrix and an increase in the amount of ferrite in the matrix.

(5) Carbon: 1.2–3.8%

C serves the purpose of enhancing the hardness and physical strength of the alloy matrix and, furthermore, combines with Cr and Fe to form compound carbides of Fe—Cr—C type. When the content of C is less than 1.2% the precipitation of such carbides remains insufficient so that the wear resistance of the sintered alloy becomes low. When the content of C is more than 3.8% the sintered alloy becomes brittle because of the precipitation of excessively large amounts of carbides during sintering, and, furthermore, the melting point of the alloy composition becomes too low so that the sintering needs to be performed under very strict control of sintering temperature in order to prevent partial melting of the material. As an additional disadvantage of an excessively high content of C, there occurs undesirably large growth of the carbide particles which will seriously attack the opposite material with which the sintered alloy is brought into rubbing contact.

Among the essential elements of the sintered alloy according to the invention, Fe, Si, C and Mn are contained also in most of conventional cast irons. Therefore, powders of such cast irons can be used as the basic material for the sintered alloy of the invention. Cast irons may contain some additional elements, but usually the additional elements can be regarded as impurity.

In principle a powder composition for a sintered alloy of the invention is obtained by adding Cr and B to a powder of a suitable cast iron. In practice, however, a Cr-B alloy in powder form is very difficult to produce at a reasonable cost. Furthermore, Cr—B alloy powder is very high in its hardness and hence offers many problems to the use thereof in powder metallurgy, the problems including inferior formability. Therefore, it is preferred to prepare a powder composition for a sintered alloy of the invention by adding a relatively small quantity of a Fe-Cr-B-Si alloy powder to a powder of a suitable cast iron which contains Si and Mn besides Fe and C. A Fe—Cr—B—Si alloy powder can be produced relatively easily and does not offer any serious problem to powder metallurgy operations. The Fe—Cr—B—Si alloy for this purpose is required to consist essentially of 10.0–35.0% of Cr, 1.0–2.5% of B, 0.5–3.0% of Si and the balance of Fe. The reasons are as follows.

If the content of Cr in the Fe—Cr—B—Si alloy is less than 10%, it becomes necessary to increase the proportion of this alloy to cast iron employed as the basic material and consequently it becomes difficult to obtain a sintered alloy in which the content of C is sufficient to form carbides needful for realization of high wear resistance. On the other hand, Fe—Cr—B—Si alloys containing more than 35% of Cr are too high in the hardness of the alloy powders so that the alloy powders are inferior in formability. The use of a Fe—Cr—B—Si alloy in which the content of B is less than 1% offers generally the same problems as the use of a Fe—Cr—B—Si alloy insufficient in the content of Cr. When the content of B is more than 2.5% there occurs precipitation of too much borides with Cr or with Fe and Cr, and the alloy powder becomes interior in formability, when the content of Si in the Fe—Cr—B—Si alloy is less than 0.5% the favorable effect of Si on the fluidity of molten metal in the preparation of the alloy remains insufficient, but the use of a Fe—Cr—B—Si alloy containing more than 3% of Si is liable to result in relatively low hardenability of the matrix of the sintered alloy.

As to cast iron powder as the basic material, it is possible to obtain a suitable powder by pulverizing chips produced in machining of cast iron parts. It is preferable to use a cast iron which consists essentially of 3.0–3.5% of C, 1.8–2.2% of Si, 0.6–1.0% of Mn and the balance of Fe, permitting the existence of small amounts of usual impurity elements.

Preferably a powder composition for a sintered alloy of the invention is prepared by mixing 10 to 25 parts by weight of a Fe—Cr—B—Si alloy powder of the above described composition with 90 to 75 parts by weight of a suitable cast iron powder to obtain 100 parts by weight of mixture. If the amount of the Fe—Cr—B—Si alloy in the mixture is less than 10% the resultant sintered alloy will suffer from insufficiency in the amounts of hard carbide and boride particles. However, when the amount of the Fe—Cr—B—Si alloy is more than 25% the powder composition becomes inferior in formability and does not produce a sufficient amount of liquid phase when subjected to sintering, so that the resultant sintered alloy suffers from relatively weak bonding of the sintered particles with one another and, hence, fails to exhibit sufficiently high hardness and wear resistance.

Of course it is also possible to prepare a powder composition for a sintered alloy of the invention by a different method. For example, such a powder composition can be obtained by mixing graphite powder with a Fe—Cr—B—Si—Mn alloy powder not containing carbon. In that case, the content of B in the alloy and the proportion of the graphite powder to the alloy powder should particularly carefully be determined with consideration of the influences on the formability of the resultant powder composition and the growth of boride particles at the stage of sintering.

A powder composition prepared in the above described manner is compacted into a desired shape by a conventional compacting method. Preferably the compacting is performed by application of a compacting pressure of 5000–8000 kg/cm$^2$.

The compacted material is subjected to sintering. It is suitable to perform the sintering either in a reducing atmosphere or in vacuum. Anyhow, it is desirable to perform the sintering in an atmosphere practically free of oxygen and moisture. As to the sintering temperature, a suitable range is from about 1100° C. to about 1150° C. When the sintering temperature is varied across 1120°-1130° C., often a difference arises in the manner of precipitation of the hard carbide and boride particles. It is recommended to determine the sintering temperature with consideration of this fact in connection with the wear resistance of the sintered alloy and the degree of attack of the alloy against opposite metallic materials with which the sintered alloy will be brought into sliding contact.

The sintered alloy bodies may optionally be subjected to a conventional surface treatment for further enhancement of the wear resistance.

The invention will further be illustrated by the following nonlimitative examples.

EXAMPLE 1

To prepare seven kinds of sintered alloys according to the invention as examples 1A, 1B, 1C, 1D, 1E, 1F and 1G, use were made of seven different kinds of conventional cast irons A–G, of which the compositions are shown in Table 1. Every cast iron was in the form of powder, which was obtained by pulverization of cast iron chips produced in machinning operations and consisted of particles that passed through a 80-mesh sieve but retained on a 250-mesh sieve.

TABLE 1

| Cast Iron | Contents of Principal Elements (Wt. %) C | Si | Mn | Note |
|---|---|---|---|---|
| A | 3.5 | 2.5 | 0.5 | gray cast iron |
| B | 3.2 | 2.0 | 0.8 | gray cast iron |
| C | 3.3 | 1.7 | 0.6 | gray cast iron |
| D | 3.0 | 2.0 | 0.9 | gray cast iron |
| E | 2.5 | 1.5 | 0.7 | malleable cast iron |
| F | 2.9 | 1.6 | 1.3 | malleable cast iron |
| G | 4.2 | 2.5 | 1.0 | spheroidal graphic cast iron |

Used as the source of Cr and B was a Fe—Cr—B—Si alloy consisting essentially of 20.0% of Cr, 1.5% of B, 0.8% of Si and the balance of Fe. The alloy was in the form of powder which entirely passed through a 100-mesh sieve. In example 1A, a powder mixture was prepared by mixing 85 parts by weight of the cast iron powder A with 15 parts by weight of the Fe—Cr—B—Si alloy powder with the addition of zinc stearete amounting to 0.75% by weight of the cast iron-alloy mixture. The mixing was carried out for 15 min in a V-shaped blender. In Examples 1B to 1G, the same mixing operation was performed by using the cast iron powders B to G, respectively, in place of the cast iron powder in Example 1A. Table 2 shows the compositions of the ferrous powder mixtures prepared in Examples 1A to 1G.

The powder mixture prepared in each of Examples 1A to 1G was compacted into the shape of a rocker arm tip for an automotive internal combustion engine by application of a pressure of 8000 kg/cm$^2$, and the compacted body was sintered in vacuum ($10^{-3}$ Torr) at 1120° C. for 45 min to obtain a rocker arm tip formed of a sintered alloy which had a porosity of 10–15%.

TABLE 2

| Example | Contents of Principal Elements (Wt. %) Cr | B | Si | C | Mn |
|---|---|---|---|---|---|
| 1A | 3.00 | 0.23 | 2.25 | 2.98 | 0.43 |
| 1B | 3.00 | 0.23 | 1.82 | 2.72 | 0.68 |
| 1C | 3.00 | 0.23 | 1.57 | 2.81 | 0.51 |
| 1D | 3.00 | 0.23 | 1.82 | 2.55 | 0.77 |
| 1E | 3.00 | 0.23 | 1.40 | 2.13 | 0.60 |
| 1F | 3.00 | 0.23 | 1.48 | 2.47 | 1.11 |
| 1G | 3.00 | 0.23 | 2.25 | 3.57 | 0.85 |

Endurance Test

The sintered rocker arm tips produced in Examples 1A to 1G were individually attached to rocker arms, which were used in a 1.8-liter in-line four-cylinder gasoline engine of the overhead camshaft type. The cams with which the rocker arm tips made rubbing contact were produced by chilled casting. The engine was operated over a period of 200 hr to examine the wear resistance and durability of the respective rocker arm tips. To accelerate the wear, the engine was operated with augmented force of the valve spring and with addition of water to the lubricating oil.

| | |
|---|---|
| Revolutions of Engine | 650 rpm |
| Lubricating oil | SAE 20W 40 |
| Lubricating Oil Temperature | 70–90° C. |
| Water Added to Lubricating Oil | 2 Wt % |
| Force of Valve Spring | 86 kg |

The results of the test are presented in the following Table 5 together with the corresponding data obtained by testing the comparative rocker arm tips produced in the reference experiments described below.

REFERENCE 1

The rocker arm tip was produced by chilled casting of a gray cast iron.

REFERENCE 2

The rocker arm was produced by machining of a machine structural carbon steel, and the tip portion of the rocker arm was subjected to a tufftriding treatment, i.e. soft-nitriding, which was carried out at 570° C. for 2 hr.

REFERENCE 3

The rocker arm was produced by machining of the machine structural steel, and a Ni base autogeneous alloy was sprayed onto the tip portion surface to build up a relatively thick hard coating layer. The alloy consisted essentially of 14% of Cr, 3% of B, 4.5% of Si, 4% of Fe, 0.6% of C and the balance of Ni.

REFERENCE 4

A powder of a ferrous alloy consisting essentially of 4% of Cr, 4% of Mo, 6% of W, 2% of V, 0.9% of C and the balance of Fe was compacted by application of a pressure of 6000 kg/cm$^2$ into the shape of the rocker arm tip, and the compacted body was sintered in vacuum at 1200° C. for 1 hr. Then the porosity of the sintered body was adjusted to 9% by repeating heating and compression. After that the sintered body was heated up to 1200° C. and quench-hardened, followed by tempering at 550° C. for 1 hr. This treatment was repeated once again to complete a sintered rocker arm tip.

REFERENCE 5A

A powder mixture was prepared by mixing 97 parts by weight of a cast iron powder with 3 parts by weight of the Fe—Cr—B—Si alloy powder used in Example 1 with the addition of zinc stearate amounting to 0.75% by weight of the cast iron-alloy mixture. The mixing was carried out for 20 min in a V-shaped blender. The cast iron contained 3.0% of C, 2.0% of Si and 0.75% of Mn. Therefore, the powder mixture contained 0.60% of Cr, 0.05% of B, 1.96% of Si, 2.91% of C and 0.73% of Mn. The powder mixture was compacted into the rocker arm tip by the same method as in Example 1, and the compacted body was sintered in vacuum ($10^{-3}$ Torr) at 1130° C. for 60 min.

REFERENCE 5B

In the process of Reference 5A, the proportion of the cast iron powder to the Fe—Cr—B—Si alloy powder was varied to 65:35 by weight. Therefore, the powder mixture for sintering contained 7.00% of Cr, 0.53% of B, 1.96% of Si, 1.95% of C and 0.49% of Mn.

REFERENCE 6

To prepare four kinds of sintered alloys, use were made of four kind of Fe—Cr—B—Si alloy powders different in composition as shown in Table 3. In Reference 6A, a powder mixture was prepared by mixing 85 parts by weight of the cast iron powder used in Reference 5 with 15 parts by weight of the Fe—Cr—B—Si alloy powder 6A with the addition of zinc stearate amounting to 0.75% by weight of the cast iron-alloy mixture by the same method as in Reference 5. In References 6B to 6D, the same mixing operation was performed by using the Fe—Cr—B—Si alloy powders 6B to 6D, respectively, in place of the alloy powder 6A in Reference 6A. Table 4 shows the compositions of the powder mixtures prepared in References 6A to 6D.

The powder mixture prepared in each of References 6A to 6D was compacted and sintered in the same manner as in Reference 5 to produce a sintered rocker arm tip.

TABLE 3

| Alloy Powder | Composition (Wt %) Cr | B | Si | F |
|---|---|---|---|---|
| 6A | 5.0 | 1.5 | 0.8 | balance |
| 6B | 45.0 | 1.5 | 0.8 | balance |
| 6C | 20.0 | 0.1 | 0.8 | balance |
| 6D | 20.0 | 5.0 | 0.8 | balance |

TABLE 4

| Reference | Contents of Principal Elements (Wt %) Cr | B | Si | C | Mn |
|---|---|---|---|---|---|
| 6A | 0.75 | 0.23 | 1.82 | 2.55 | 0.64 |
| 6B | 6.75 | 0.23 | 1.82 | 2.55 | 0.64 |
| 6C | 3.00 | 0.02 | 1.82 | 2.55 | 0.64 |
| 6D | 3.00 | 0.75 | 1.82 | 2.55 | 0.64 |

TABLE 5

| | Results of Endurance Test: Amount of Wear of Rocker Arm Tip (μm) | Amount of Wear of Cam (μm) |
|---|---|---|
| Example 1A | 15–20 | 20–30 |
| Example 1B | 10–20 | 20–25 |
| Example 1C | 15–25 | 15–25 |

TABLE 5-continued

| | Results of Endurance Test: Amount of Wear of Rocker Arm Tip (μm) | Amount of Wear of Cam (μm) |
|---|---|---|
| Example 1D | 10–15 | 15–30 |
| Example 1E | 20–40 | 25–40 |
| Example 1F | 25–35 | 20–30 |
| Example 1G | 5–10 | 10–40 |
| Reference 1 | 25–150 | 100–150 |
| Reference 2 | 250–350 | 40–50 |
| Reference 3 | 20–40 | 120–140 |
| Reference 4 | 10–35 | 135–160 |
| Reference 5A | 150–200 | 5–15 |
| Reference 5B | 170–220 | 20–30 |
| Reference 6A | 80–120 | 15–25 |
| Reference 6B | 180–200 | 40–60 |
| Reference 6C | 35–50 | 10–20 |
| Reference 6D | 5–10 | 130–155 |

As can be seen in Table 5, the sintered rocker arm tips of Examples 1A to 1G were superior to the rocker arms or rocker arm tips of References 1 to 6 in wear resistance and/or in the degree of attack against the cams with which the samples made rubbing contact.

EXAMPLE 2

Use was made of a cast iron in the form of powder, which was obtained by pulverization of cast iron chips produced in machining operations and consisted of particles that passed through a 60-mesh sieve and retained on a 320-mesh sieve. The cast iron consisted essentially of 2.9% of C, 2.1% of Si, 0.8% of Mn and the balance of Fe. To prepare eight kinds of sintered alloys according to the invention, use were made of eight kinds of Fe—Cr—B—Si alloy powders different in composition as shown in Table 6. In Example 2A, a powder mixture was prepared by mixing 80 parts by weight of the cast iron powder with 20 parts by weight of the Fe—Cr—B—Si alloy powder 2A with the addition of zinc stearate amounting to 0.75% by weight of the cast iron-alloy mixture. The mixing was carried out for 20 min in a V-shaped blender. In Examples 2B to 2H, the same mixing operation was performed by using the Fe—Cr—B—Si alloy powders 2A to 2H, respectively, in place of the alloy powder 2A in Example 2A. Table 7 shows the compositions of the ferrous powder mixtures prepared in Examples 2A to 2H.

The powder mixture prepared in each of Examples 2A to 2H was compacted into the shape of the rocker arm tip by application of a pressure of 8000 kg/cm$^2$, and the compacted body was sintered in vacuum ($10^{-3}$ Torr) at 1135° C. for 30 min to obtain a rocker arm tip formed of a sintered alloy which had a porosity of 5–10%.

The sintered rocker arm tips produced in Examples 2A to 2H were subjected to the endurance test described hereinbefore. The results are shown in Table 9 together with the results of the same test on the products of Example 3.

TABLE 6

| Alloy Powder | Composition (Wt %) Cr | B | Si | F |
|---|---|---|---|---|
| 2A | 15.0 | 1.0 | 1.0 | balance |
| 2B | 15.0 | 2.0 | 1.0 | balance |
| 2C | 20.0 | 1.0 | 1.0 | balance |
| 2D | 20.0 | 2.0 | 1.0 | balance |
| 2E | 25.0 | 1.0 | 1.0 | balance |
| 2F | 25.0 | 2.0 | 1.0 | balance |
| 2G | 30.0 | 1.0 | 1.0 | balance |

TABLE 6-continued

| Alloy Powder | Composition (Wt %) | | | |
|---|---|---|---|---|
| | Cr | B | Si | F |
| 2H | 30.0 | 2.0 | 1.0 | balance |

TABLE 7

| Example | Contents of Principal Elements (Wt %) | | | | |
|---|---|---|---|---|---|
| | Cr | B | Si | C | Mn |
| 2A | 3.00 | 0.20 | 1.88 | 2.32 | 0.64 |
| 2B | 3.00 | 0.40 | 1.88 | 2.32 | 0.64 |
| 2C | 4.00 | 0.20 | 1.88 | 2.32 | 0.64 |
| 2D | 4.00 | 0.40 | 1.88 | 2.32 | 0.64 |
| 2E | 5.00 | 0.20 | 1.88 | 2.32 | 0.64 |
| 2F | 5.00 | 0.40 | 1.88 | 2.32 | 0.64 |
| 2G | 6.00 | 0.20 | 1.88 | 2.32 | 0.64 |
| 2H | 6.00 | 0.40 | 1.88 | 2.32 | 0.64 |

EXAMPLE 3

Used as the basic material was the cast iron powder described in Reference 5A, which consisted of particles passed through a 60-mesh sieve and retained on a 320-mesh sieve. Used as the source of Cr and B was the Fe—Cr—B—Si alloy powder described in Reference 5A.

In Example 3A, a powder mixture was prepared by mixing 90 parts by weight of the cast iron powder with 10 parts by weight of the Fe—Cr—B—Si alloy powder with the addition of zinc stearate amounting to 0.75% by weight of the cast iron-alloy mixture. In Examples 3B, 3C and 3D, the proportion of the cast iron powder to the Fe—Cr—B—Si alloy powder was varied to 85:15, to 80:20 and to 75:25, respectively. Table 8 shows the compositions of the powder mixtures prepared in Examples 3A to 3D.

The powder mixture prepared in each of Examples 3A to 3D was compacted into the shape of the rocker arm tip by application of a pressure of 8000 kg/cm$^2$, and the compacted body was sintered in vacuum ($10^{-3}$ Torr) at 1125° C. for 60 min to obtain a rocker arm tip formed of a sintered alloy which had a porosity of 10–15%.

TABLE 8

| Example | Contents of Principal Elements (Wt %) | | | | |
|---|---|---|---|---|---|
| | Cr | B | Si | C | Mn |
| Example 3A | 2.00 | 0.15 | 1.88 | 3.00 | 0.68 |
| Example 3B | 3.00 | 0.23 | 1.82 | 2.55 | 0.64 |
| Example 3C | 4.00 | 0.30 | 1.84 | 2.40 | 0.60 |

TABLE 8-continued

| Example | Contents of Principal Elements (Wt %) | | | | |
|---|---|---|---|---|---|
| | Cr | B | Si | C | Mn |
| Example 3D | 5.00 | 0.38 | 1.70 | 2.25 | 0.56 |

TABLE 9

| | Amount of Wear of Rocker Arm Tip (μm) | Amount of Wear of Cam (μm) |
|---|---|---|
| Example 2A | 10–15 | 20–30 |
| Example 2B | 15–20 | 10–25 |
| Example 2C | 10–20 | 15–30 |
| Example 2D | 15–25 | 15–25 |
| Example 2E | 15–20 | 15–25 |
| Example 2F | 15–25 | 10–20 |
| Example 2G | 15–25 | 15–25 |
| Example 2H | 20–30 | 10–20 |
| Example 3A | 15–20 | 15–20 |
| Example 3B | 10–15 | 15–25 |
| Example 3C | 5–10 | 25–40 |
| Example 3D | 5–10 | 20–45 |

As can be seen in Table 9, the sintered rocker arm tips of Examples 2 and 3 were excellent and comparable to the products of Example 1 in wear resistance and degree of attack against the cams with which the samples made rubbing contact.

What is claimed is:

1. A wear-resistant sintered ferrous alloy consisting essentially of 2.0 to 8.0% of Cr, 0.1 to 1.0% of B, 1.0 to 2.5% of Si, 0.3 to 1.2% of Mn, 1.2 to 3.8% of C, by weight, and the balance of Fe.

2. A method of producing a wear-resistant sintered ferrous alloy, the method comprising the steps of:

preparing a powder mixture which consists essentially of 2.0 to 8.0% of Cr, 0.1 to 1.0% of B, 1.0 to 2.5% of Si, 0.3 to 1.2% of Mn, 1.2 to 3.8% of C, by weight, and the balance of Fe;

compacting said powder mixture into a body of a desired shape; and sintering said body in a nonoxidizing atmosphere.

3. A method according to claim 2, wherein said powder mixture is prepared by mixing a powder of a cast iron with a powder of a quaternary alloy which consists essentially of 10.0 to 35.0% of Cr, 1.0 to 2.5% of B, 0.5 to 3.0% of Si, by weight, and the balance of Fe, the proportion of the cast iron powder to the quaternary alloy powder being in the range from 75:25 to 90:10 by weight.

4. A method according to claim 3, wherein said cast iron contains 1.8 to 2.2% of Si, 0.6 to 1.0% of Mn, 3.0 to 3.5% of C by weight.

5. A method according to claim 3, wherein the sintering is performed at a temperature in the range from about 1100° C. to about 1150° C.

* * * * *